United States Patent [19]

Abrahams

[11] 4,052,853

[45] Oct. 11, 1977

[54] HOT-GAS RECIPROCATING MACHINE COMPRISING TWO OR MORE WORKING SPACES, PROVIDED WITH A CONTROL DEVICE FOR THE SUPPLY OF WORKING MEDIUM TO THE SAID WORKING SPACES

[75] Inventor: Jacobus Hubertus Abrahams, Eindhoven, Netherlands

[73] Assignee: U.S. Philips Corporation, New York, N.Y.

[21] Appl. No.: 721,671

[22] Filed: Sept. 9, 1976

[30] Foreign Application Priority Data

Sept. 19, 1975 Netherlands ..... 7511043

[51] Int. Cl.[2] ..... F02G 1/06

[52] U.S. Cl. ..... 60/521

[58] Field of Search ..... 60/521, 522; 62/6

[56] References Cited

U.S. PATENT DOCUMENTS

| | | | |
|---|---|---|---|
| 3,699,770 | 10/1972 | Bennethum | 60/521 |
| 3,802,197 | 4/1974 | Gothberg | 60/521 |

*Primary Examiner*—Allen M. Ostrager
*Attorney, Agent, or Firm*—Frank R. Trifari; David R. Treacy

[57] ABSTRACT

A hot-gas reciprocating machine involving a plurality of cycles having a mutually different phase, during each crank shaft revolution working medium from a source of pressurized working medium being successively supplied to each cycle separately, via a control device, comprising one or more slides which are controlled exclusively by the variable cycle pressures.

2 Claims, 14 Drawing Figures

Figure 1:
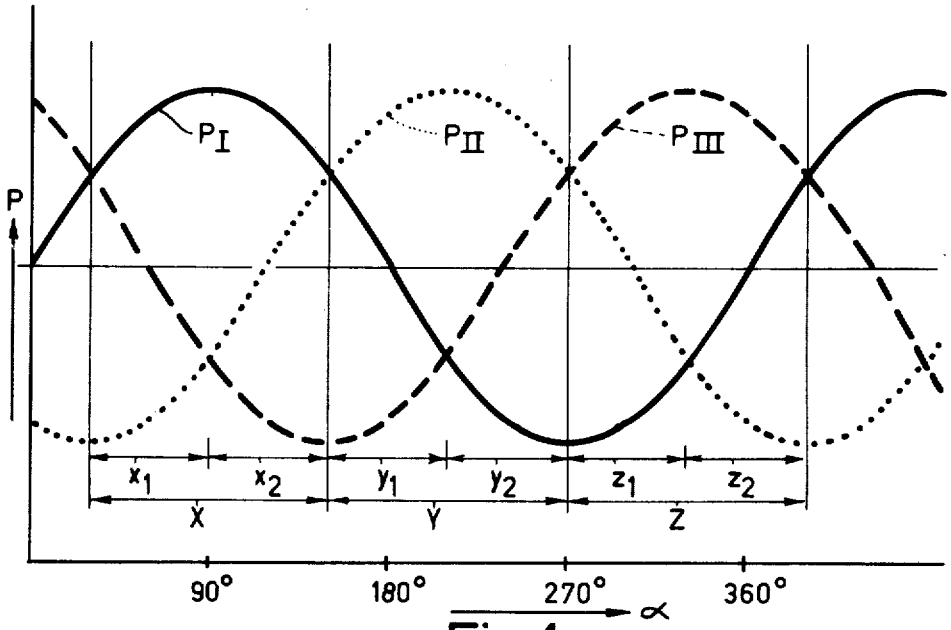

HOT-GAS RECIPROCATING MACHINE COMPRISING TWO OR MORE WORKING SPACES, PROVIDED WITH A CONTROL DEVICE FOR THE SUPPLY OF WORKING MEDIUM TO THE SAID WORKING SPACES

The invention relates to a hot-gas reciprocating machine comprising two or more working spaces, the volumes of which can be varied at a mutual phase difference by piston-like bodies which are coupled to a crank shaft, a working medium completing a thermodynamic cycle in each of the said working spaces during operation, each of the working spaces being connected, via an associated supply duct which includes a non-return valve which opens in the direction of the relevant working space, to a control device which, during each revolution of the crank shaft, successively connects each of the supply ducts separately to a source of pressurized working medium, the said control device comprising at least one control member which is slidable in a housing in the direction of its longitudinal axis under the influence of medium pressures which act on the control member in a mutually opposed sense, the said housing comprising at least one inlet port which is connected to the source and at least one outlet port which is connected to the supply duct.

A hot-gas reciprocating machine of the kind set forth is described in the pending Netherlands Patent Application No. 7,407,951 to which co-pending U.S. application Ser. No. 692,126 corresponds.

Within the scope of the present Application, hot-gas reciprocating machines are to be understood to mean hot-gas reciprocating engines, cold-gas refrigerating machines and heat pumps. In each of the working spaces of these machines the working medium is alternately compressed when it is mainly present in a sub-space, the compression space, is subsequently transported, via a regenerator, to a sub-space, the expansion space, is subsequently expanded, when the working medium is mainly present in the expansion space, and is finally returned, via the regenerator, to the compression space, the cycle then having been completed. During operation, the compression space and expansion space have mutually different mean temperatures.

The piston-like bodies which vary the volumes of the different working spaces are coupled to the crank shaft at a mutually different crank angle.

Consequently, a mutual phase difference exists between the working spaces as regards the volume variation or pressure variation occurring in each working space.

The power of the machine can be increased by increasing the quqntity of working medium present in the various working spaces of the machine.

The control device of the hot-gas reciprocating machine proposed in the Netherlands Patent Application No. 7,407,951 consists of a rotor which is rotatable with respect to an enveloping housing and which is coupled to a shaft of the machine, the said rotor also being reciprocable in the axial direction under the influence of on the one hand a pressure corresponding to an instantaneous cycle pressure periodically occurring in a working space (for example, the minimum, the mean of the maximum cycle pressure) and the source pressure on the other hand.

When the power of this hot-gas reciprocating machine is increased, working medium is supplied to each working space, initially exclusively due to the rotation of the rotor, during each revolution of the crank shaft for the period during which the maximum cycle pressure occurs in the relevant working space. The highest pressure of the working medium thus increases, so that the supplied working medium directly participates in the expansion without the machine first having to perform compression labour on the supplied medium which would cause an initial decrease of the torque. Subsequently, a gradual change-over from feeding working medium at maximum cycle pressure to feeding at minimum cycle pressure automatically takes place in that, due to the fact that on the one hand the increasing continuous pressure acting on the rotor, representing the instantaneous cycle pressure, and on the other hand the decreasing source pressure acting on the rotor, the rotor gradually assumes an axial position, so that all outlet ports of the housing, come into open communication with the inlet port.

The proposed hot-gas reciprocating machine has some drawbacks. The high working medium pressures necessitate proper sealing of the rotor shaft relative to the housing in order to prevent leakage of working medium to the surroundings. A high-pressure seal between mutually rotating parts, however, has a short service life.

Severe requirements are imposed on the control mechanism as regards dimensional accuracy (for example, very fine ducts in the rotor and in the correct location in view of the instant of medium supply).

The instant of supply must be detectable and adjustable. This necessitates marks on the shaft of the machine and/or rotor and on the housing. Because a slip-free coupling between the rotor and a shaft of the machine is required, little freedom exists as regards the mounting location of the control device.

The present invention has for its object to provide an improved hot-gas reciprocating machine of the kind set forth in which the described drawbacks have been eliminated.

In order to realize this object, the hot-gas reciprocating machine in accordance with the invention is characterized in that the control device is constructed so that each control member is controlled exclusively as a slide by two mutually phase-shifted cycle pressures which are associated per control member with different working spaces or, relative to the control members mutually, with different pairs of working spaces.

The variable cycle pressures as control pressures ensure that, when the control member or the control members are suitably connected, per crank shaft revolution working medium is automatically applied to each working space during a part of the cycle occurring in this working space, while coupling of the control member or the control members to a shaft of the machine is avoided.

In a preferred embodiment of the hot-gas reciprocating machine in accordance with the invention, there is provided a pressure-controlled switch which is included in a central communication duct which is connected on one side to the source of pressurized working medium and on the other side to the working spaces via communication ducts which are separately connected to the working spaces, each of the said communication ducts including a non-return valve which opens in the direction of the associated working space, the said switch being adapted to switch off the control device and to release the central communication duct when a given pressure level in the working spaces is exceeded, and to close the central communication duct and to switch on the control device when the pressure falls below the said pressure level.

This is advantageous in all cases where the control device provides the supply of working medium to the working spaces each time during a part of the relevant cycle which does not include the minimum cycle pressure.

When working medium is applied to the working spaces, the pressure level in the working spaces increases and the pressure of the working medium in the sources decreases, so that it becomes increasingly difficult to supply working medium to a cycle, for example, at maximum cycle pressure. The switch ensures that at a given instant working medium is applied, via the central communication duct, to the working spaces each time when the minimum cycle pressure occurs in a working space.

The invention will be described in detail hereinafter with reference to the drawing.

FIG. 1 is a graph of the pressure course for the three thermodynamic cycles of a three-space hot-gas reciprocating machine which have a mutual phase difference of 120 °.

Figure 2A:
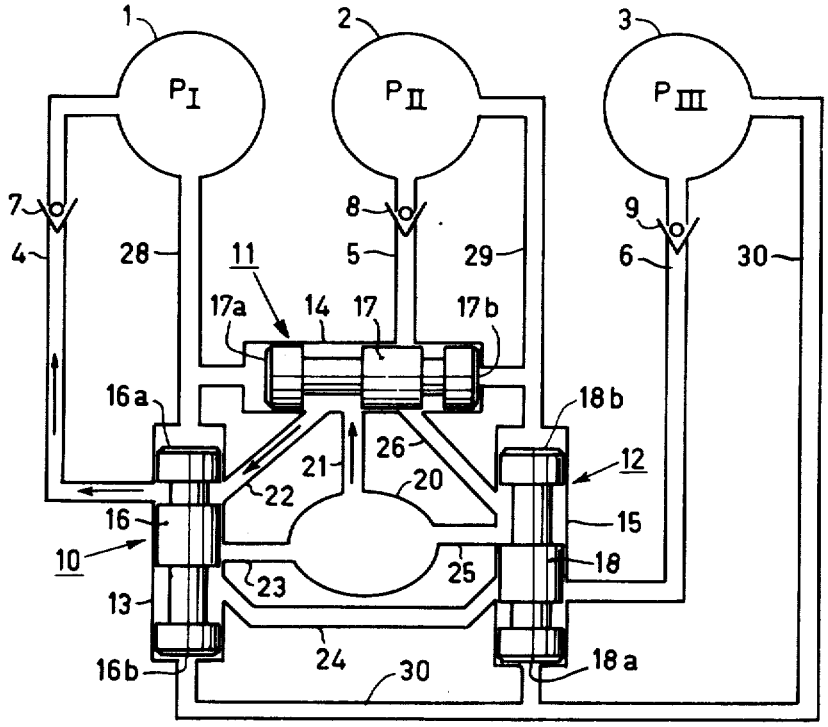

FIG. 2*a* is a longitudinal sectional view of the three working spaces of a hot-gas reciprocating machine in which the cycles shown in FIG. 1 are completed, in combination with a control device in a given operating condition.

Figure 2B:
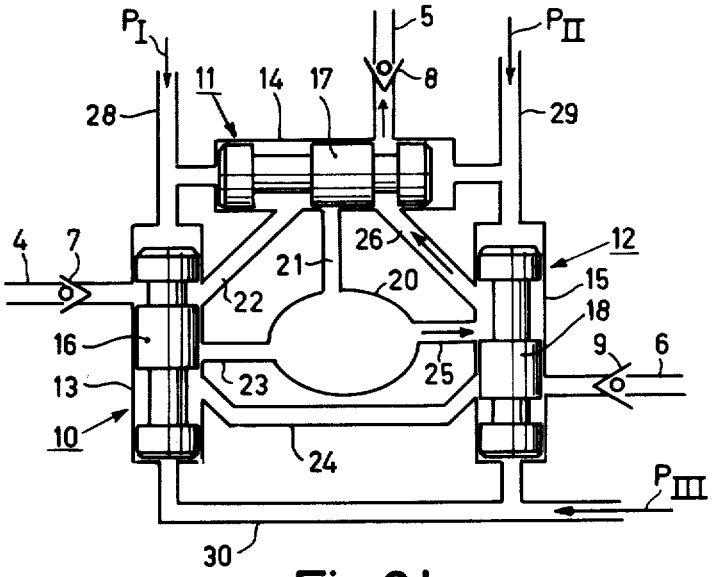
Figure 2C:
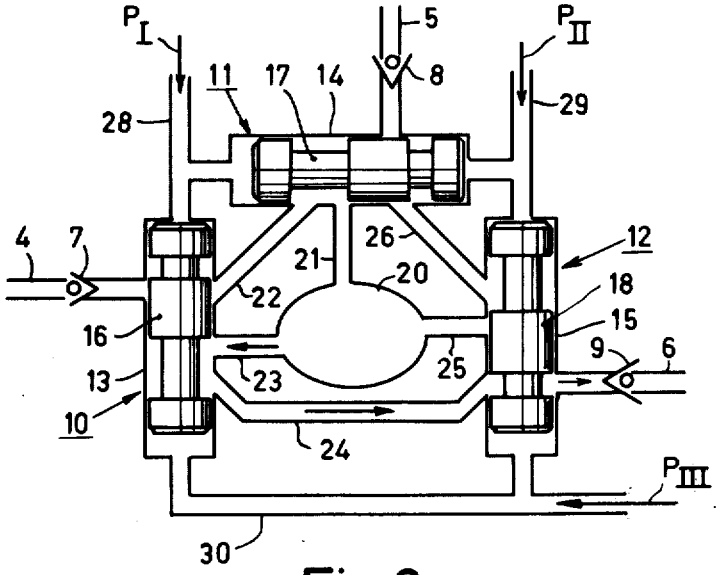

FIGS. 2*b* and 2*c* show further operating conditions of the control device shown in FIG. 2*a*.

Figure 3:
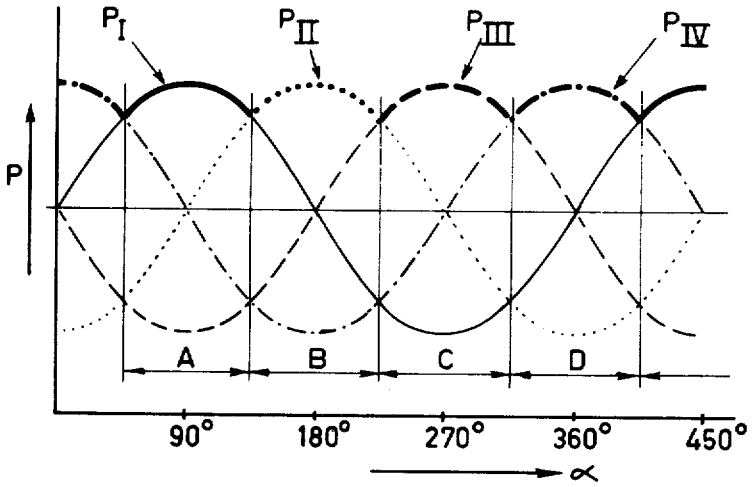

FIG. 3 graphically shows the pressure course for the four thermodynamic cycles, phase-shifted 90° relative to each other, of a four-space hot-gas reciprocating machine.

Figure 4B:
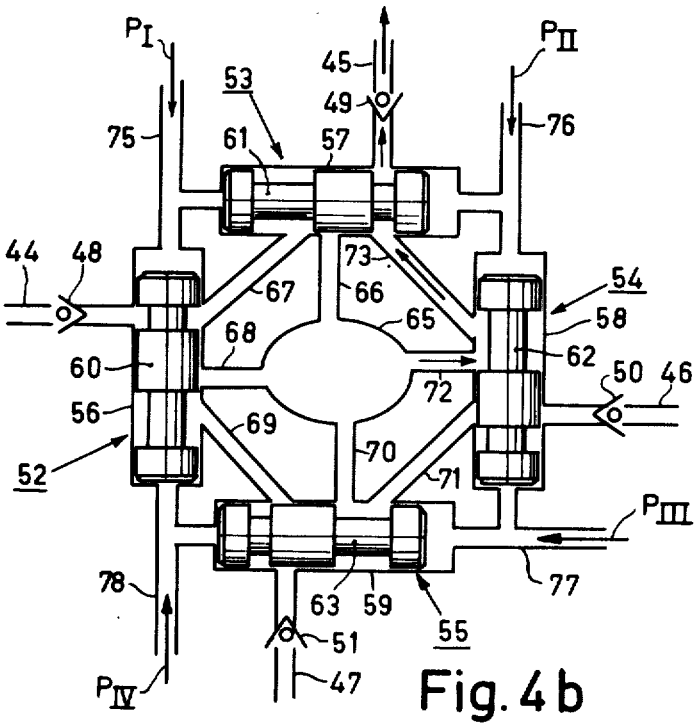
Figure 4A:
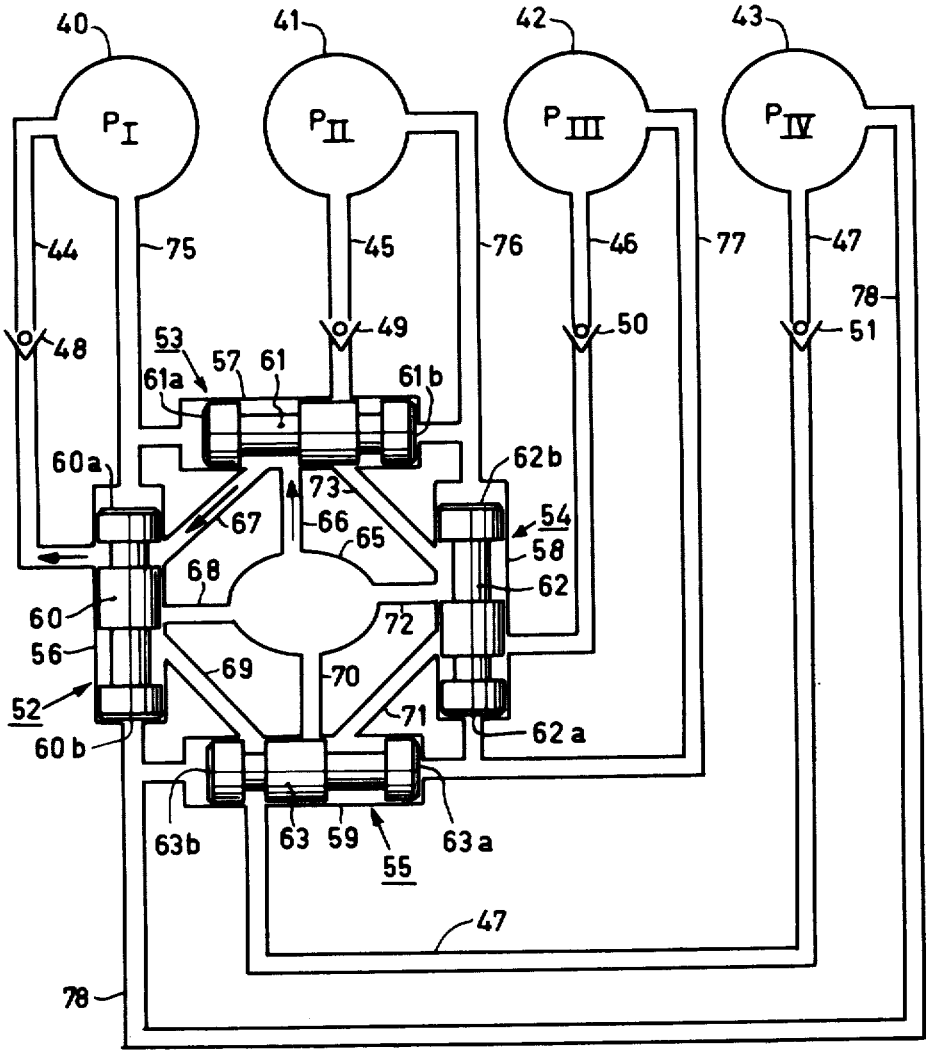

FIG. 4*a* is a longitudinal sectional view of the four working spaces of a hot-hgas reciprocating machine in which the cycles shown in FIG. 3 are completed, in combination with a control device in a given operating condition.

Figure 4C:
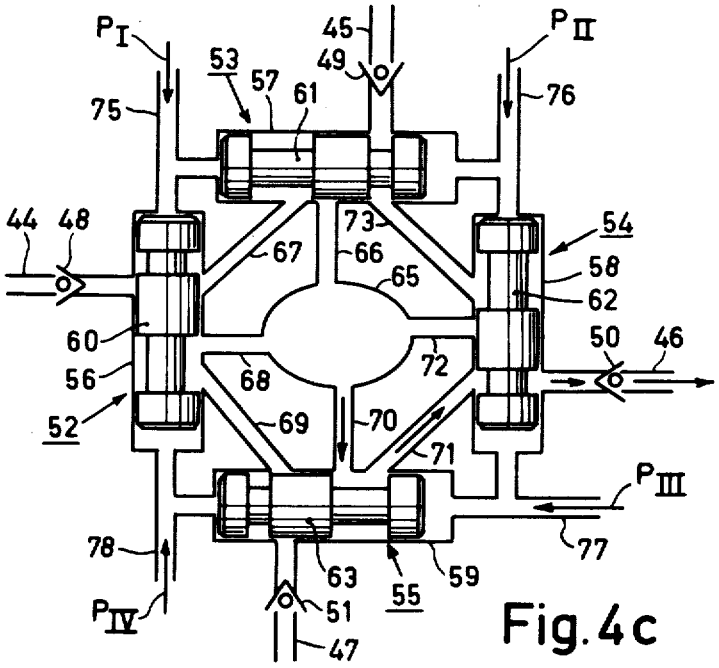
Figure 4D:
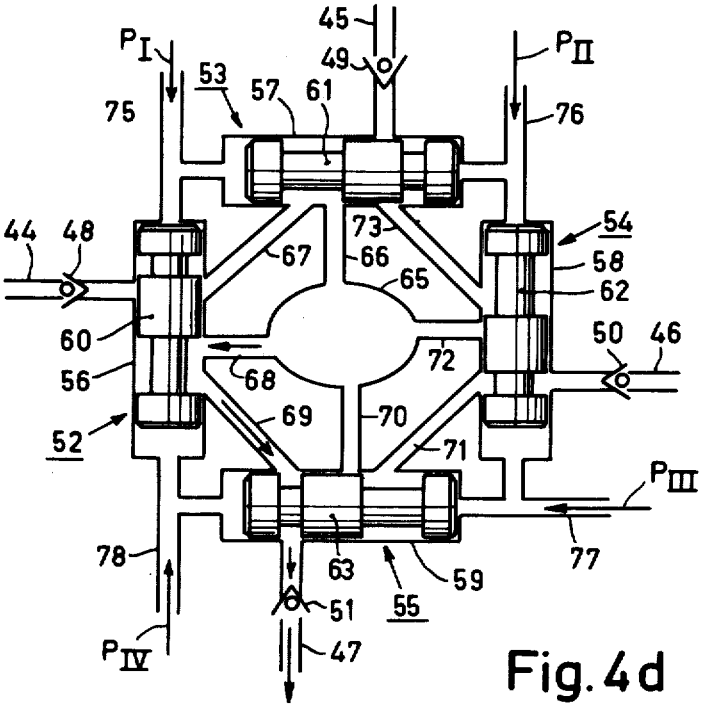

FIGS. 4*b* and 4*d* show further operating conditions of the control device of FIG. 4*a*.

FIGS. 5*a* to 5*d* show different operating conditions of a simplified control device for a four-space hot-gas reciprocating machine.

Figure 5A:
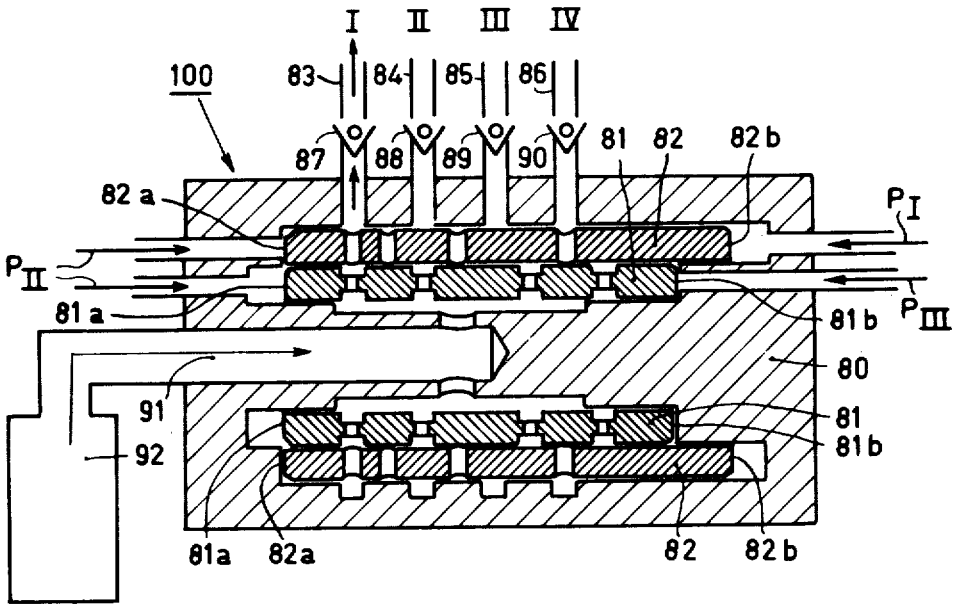
Figure 5B:
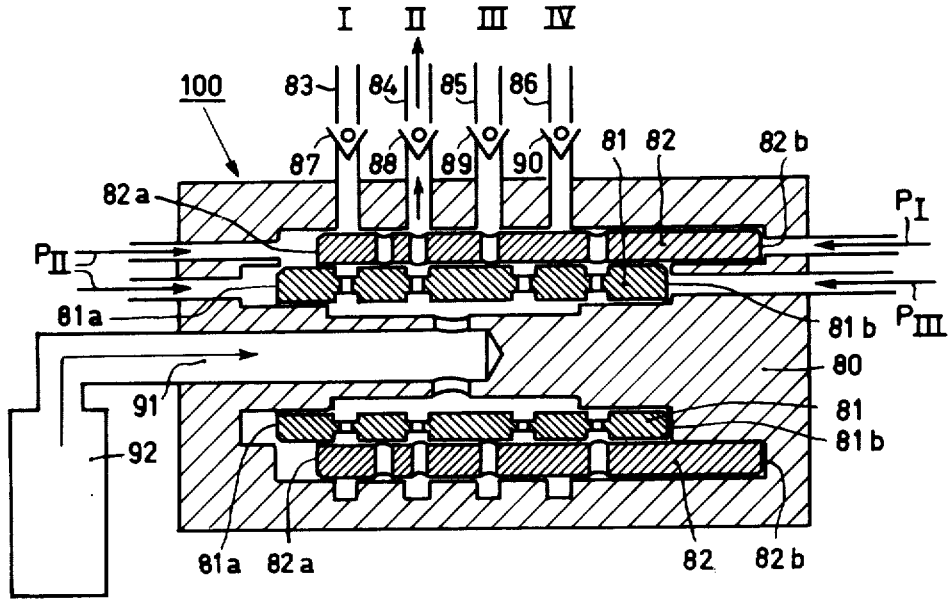
Figure 5C:
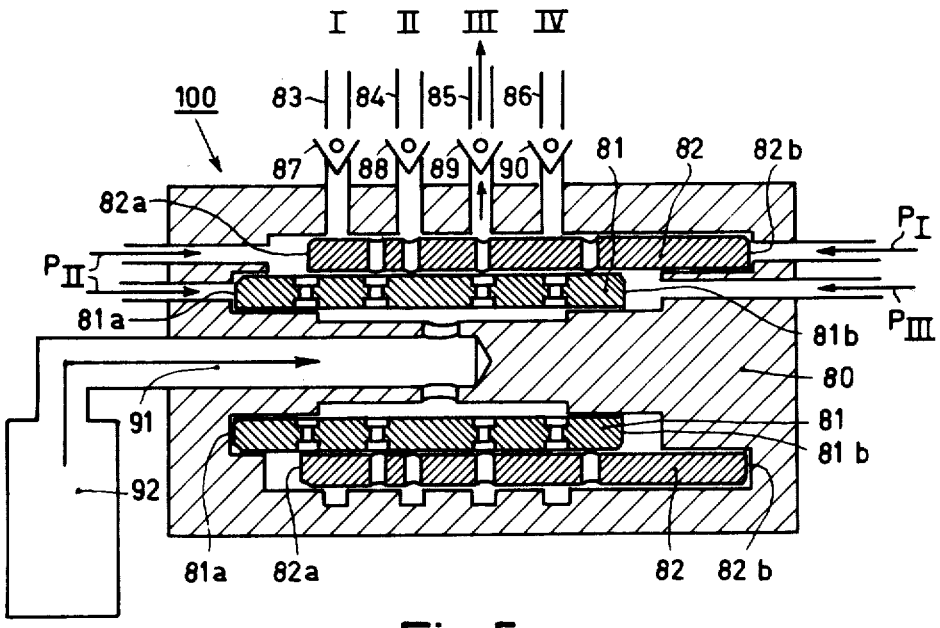
Figure 5D:
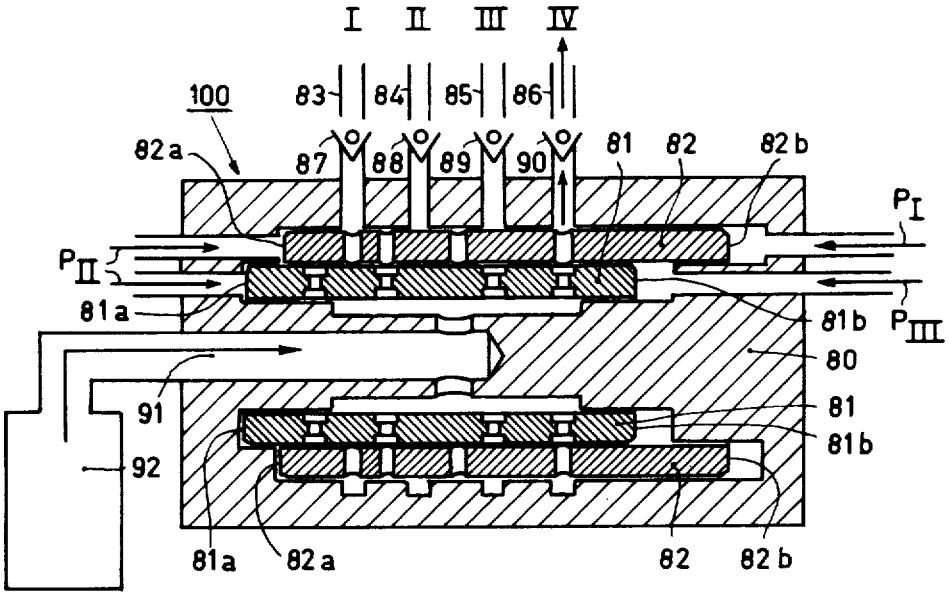
Figure 6:
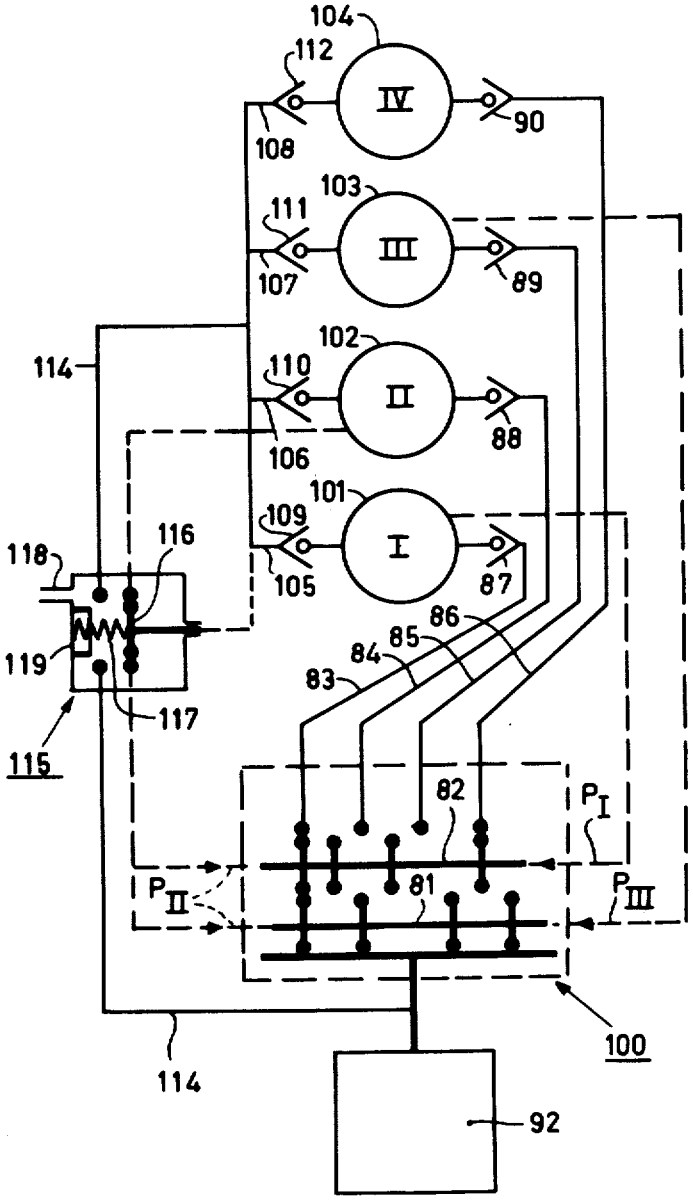

FIG. 6 is a longitudinal sectional view of the four working spaces of a hot-gas reciprocating machine comprising the control device of FIG. 5, now diagrammatically shown, and a pressure-controlled switch.

FIG. 1 shows the pressure P as a function of the crank shaft angle $\alpha$, varying in the time, for the three thermodynamic cycles I, II and III (denoted by an uninterrupted line, a dotted line and a dashed line respectively)of a three-space hot-gas reciprocating machine whose cranks mutually enclose an angle of 120° with the crank shaft, the mutual phase difference between the variable cycle pressures thus amounting to 120°.

The reference numerals 1, 2 and 3 in FIG. 2*a* denote the three working spaces of the hot-gas reciprocating machine in which the three cycles I, II and III of FIG. 1 are completed.

Each of the working spaces 1, 2 and 3 has connected thereto a supply duct 4, 5 and 6, respectively, which inlcudes a non-return valve 7, 8 and 9, respectively, which opens in the direction of the relevant working space. Each of the ends of the supply ducts 4, 5 and 6 which are remote from the working spaces 1, 2 and 3 is connected to a control member 10, 11 and 12, respectively. Each of the control members 10, 11 and 12 consists of a housing 13, 14 and 15, respectively, which is provided with ports and in which an associated slide 16, 17, 18, respectively, is reciprocable in its longitudinal direction.

The control members 10, 11 and 12 are interconnected and connected to a storage vessel 20 for pressurized working medium via the ducts 21 to 26.

The end face 16*a* of the slide 16 and the end face 17*a* of the slide 17 are subject to the variable cycle pressure $P_I$ of the working space 1 via a duct 28.

The end face 17*b* of the slide 17 and the end face 18*b* of the slide 18 are subject to the variable cycle pressure $P_{II}$ of the working space 2 a duct 29.

The end face 16*b* of the slide 16 and the end face 18*a* of the slide 18 are subject to the variable cycle pressure $P_{III}$ of the working space 3 via a duct 30.

During operation of the hot-gas reciprocating machine, the cycle pressure $P_I > P_{II}$ and $P_I > P_{III}$ for the entire interval X (FIG. 1). The slides 17 and 16 are then in the positions shown in FIG. 2*a*. Pressurized working medium then flows from the storage vessel 20, via the duct 21, the control member 11, the duct 22, the control member 10 and the supply duct 4, to the working space 1. Working medium is thus supplied to the working space 1 during a part of the cycle I in which the cycle pressure assumes its maximum value. During the interval $X_1$, $P_{III} > P_{II}$, and during the interval $x_2$, $P_{III} < P_{II}$. This means that the slide 18 of the control member 12 (FIG. 2*a*) is initially in its upper position (not shown) and subsequently assumes the lower position as shown in FIG. 2*a*. The duct 25 is closed in the upper position of the slide 18, so that working medium cannot flow from the storage vessel 20 via the duct 25. In the lower position of the slide 18 shown, the duct 25 is released, but the connecting duct 26 is blocked by the slide 17, so that working medium cannot flow from the storage vessel 20 via the duct 25 either. Consequently, during the interval X working medium is supplied from the storage vessel 20 exclusively to the working space 1, regardless of the position of the slide 18.

In FIGS. 2*b* and 2*c* use is made of the same reference numerals for parts corresponding to FIG. 2*a*.

During the entire interval Y (FIG. 1), $P_{II} > P_I$ and $P_{II} > P_{III}$, so that the slides 17 and 18 occupy the position shown in FIG. 2*b* and pressuirzed working medium flows from the storage vessel 20, via the duct 25, the control member 12, the duct 26, the control member 11 and the supply duct 5, to the working space 2 during the part of the cycle II in which the maximum cycle pressure occurs. During the interval $y_1$ (FIG. 1) $P_I > P_{III}$, and during the interval $Y_2$, $P_I < P_{III}$, so that at the change-over from the one to the other interval, the slide 16 changes over from its upper position (not shown) to its lower position shown in FIG. 2*b*. However, in both positions no working medium from the storage vessel 20 can leave the control device via the duct 23. Consequently, working medium is again applied exclusively to one working space, that that is to say the working space 2.

Finally, during the entire interval Z (FIG. 1) $P_{III} > P_I$ and $P_{III} > P_{II}$. The slides 16 and 18 are then in the position shown in FIG. 2*c*. Working medium then flows from the storge vessel 20, via the duct 23, the control member 10, the duct 24, the control member 12 and the supply duct 6, to the working space 3 during a period in which the maximum cycle pressure occurs in this working space. At the change-over from the interval $z_1$ to the interval $z_2$, $P_I < P_{II}$ becomes $P_I > P_{II}$, so that the slide 17 changes over from the extreme left position to the extreme right position shown in FIG. 2c. However, in both positions of the slide 17 no working medium from the storage vessel 20 can leave the control device via the duct 21, so that working medium flows only to the working space 2 during the interval Z.

FIG. 3 shows the pressure P as a function of the time-dependent crank shaft angle$\alpha$ for the four cycles I, II, III and IV (denoted by a non-interrupted line, a dotted line, a dashed line and a dashed-dot line, respectively) of a four-space hot-gas reciprocating machine, the said cycles having a mutual phase difference of 90° in the cycle pressure.

The reference numerals 40, 41, 42 and 43 in FIG. 4a denote the four working spaces of a hot-gas reciprocating machine in which the cycles I, II, III and IV, respectively, of FIG. 3, are completed.

Each working space has connected thereto an associated supply duct 44, 45, 46, 47, respectively, which includes a non-return valve 48, 49, 50 and 51, respectively, which opens in the direction of the relevant working space. Each of the ends of the supply ducts 44, 45, 46, and 47 which is remote from the working space is connected to a control member 52, 53, 54 and 55, respectively. Each of the control members 52, 53, 54 and 55 consists of a housing 56, 57, 58 and 59, respectively, which is provided with ports and in which an associated slide 60, 61, 62 and 63, respectively, is reciprocable in its longitudinal direction.

The control members 52 to 55 are interconnected and are connected to a storage vessel 65 for pressurized working medium via ducts 66, 67, 68, 69, 70, 71, 72 and 73. The end face 60a of the slide 60 and the end face 61a of the slide 61 are subject to the variable cycle pressure $P_I$ of the working space 40 via a duct 75.

The end face 61b of the slide 61 and the end face 62b of the slide 62 are subject, via a duct 76, to the variable cycle pressure $P_{II}$ of the working space 41. The end face 62a of the slide 62 and the end face 63a of the slide 63 are subject, via a duct 77, to the variable cycle pressure $P_{III}$ of the working space 42.

The end face 63b of the slide 63 and the end face 60b of the slide 60 are subject, via a duct 78, to the variable cycle pressure $P_{IV}$ of the working space 43.

During operation of the hot-gas reciprocating machine, $P_I > P_{II}$, $P_I > P_{IV}$, $P_{II} > P_{III}$ and $P_{IV} > P_{III}$ during the entire interval A (FIG. 3), so that the relevant slides 61, 60, 62 and 63 assume the positions shown in FIG. 4a during this interval, A. High-pressure working medium flows from the storage vessel 65, via the duct 66, the control member 53, the duct 67, the control member 52 and the supply duct 44, to the working space 40 in which the cycle I is completed. In FIGS. 4b, 4c and 4d the same references are used for parts corresponding to FIG. 4a.

FIG. 4b shows the position of the slides 60 to 63 during the interval B of FIG. 3, during which $P_{II} > P_I$, $P_{II} > P_{III}$, $P_{III} > P_{IV}$ and $P_I > P_{IV}$. Working medium then flows from the storage vessel 65, via the duct 72, the control member 54, the duct 73, the control member 53 and the supply duct 45, exclusively to the working space 41 in which the cycle II is completed.

During the interval C of FIG. 3, during which $P_I$ with $< P_{II}$, $P_I < P_{IV}$, $P_{II} < P_{III}$ and $P_{IV} < P_{III}$, the slides 60 to 63 occupy the positions shown in FIG. 4c. Working medium is then applied from the storage vessel 65 exclusively to the working space 42 in which the cycle III is completed, via successively the duct 70, the control member 55, the duct 71, the control member 54 and the supply duct 46.

Finally, during the interval D of FIG. 3, during which $P_I > P_{II}$, $P_{III} > P_{II}$, $P_{IV} > P_I$ and $P_{IV} > P_{III}$, the slides 60 to 63 are in the positions shown in FIG. 4d.

During the said interval D, working medium is supplied from the storage vessel 65 exclusively to the working space 43 in which the cycle IV is completed, that is to say via successively the duct 68, the control member 52, the duct 69, the control member 55 and the supply duct 47.

In the embodiments shown in the FIGS. 2 and 4, working medium is applied, via the control device, to each working space of the hot-gas reciprocating machine during a part of the cycle completed in the relevant working space during which the maximum cycle pressure occurs. The supply of working medium, however, can alternatively be effected during another part of this cycle, notably by interchanging the connections of the supply ducts to the working spaces.

The control device of the three-space machine shown in FIG. 2 comprises, inter alia for the sake of clarity, three slides, and the four-space machine shown in FIG. 4 comprises four slides. However, a variety of, other, simpler control devices which require fewer slides are alternatively feasible. This is further elaborated in FIG. 5, which shows a control device 100 for the four-space machine of FIG. 4 which comprises only two slides which are accommodated in the same housing and which are constructed as cylindrical bushings.

This control device 100 comprises a housing 80 within which two coaxially arranged slides 81 and 82 are axially reciprocable. The housing 80 has connected to it four supply ducts 83, 84, 85 and 86, respectively, each of the free ends of which is connected to an associated working space (not shown) of the hot-gas reciprocating machine. The thermodynamic cycles I, II and III and IV are completed in the said working spaces. Each of the four supply ducts 83, 84, 85 and 86 includes a non-return valve 87, 88, 89 and 90, respectively, which opens in the direction of the relevant working space.

A central bore 91 in the housing 80 communicates with a storage vessel 92 for pressurized working medium.

The end faces 81a and 82a of the slides 81 and 82 are subject to the variable cycle pressure $P_{II}$ of the cycle II. The end face 81b of the slide 81 is subject to the variable cycle pressure $P_{III}$ of the cycle III, while the end face 82b of the slide 82 is subject to the variable cycle pressure $P_I$ of the cycle I.

As has already been stated in the description with reference to FIG. 3, $P_I > P_{II}$ and $P_{II} > P_{III}$ during the interval A. The position of the slides 82 and 81 is then as shown in FIG. 5a. Consequently, during the interval A working medium is supplied exclusively to the cycle I from the storage vessel 92 via the supply duct 83.

During the interval B of FIG. 3, $P_{II} > P_I$ and $P_{II} > P_{III}$, so that the slides 81 and 82 occupy the positions shown in FIG. 5b. Working medium is then exclusively supplied to the cycle II via the supply duct 84.

For the interval C of FIG. 3, $P_{III} > P_{II}$ and $P_{II} > P_I$. In the positions of the slides 81 and 82 shown in FIG. 5c, working medium is supplied exclusively to the cycle III from the storage vessel 92 via the supply duct 85 during the interval C.

Finally, it appears that $P_I > P_{II}$ and $P_{III} > P_{II}$ during the interval D of FIG. 3. The slides 81 and 82 are then in the positions shown in FIG. 5*d*. Consequently, during the interval D working medium is supplied from the storage vessel 92, via the supply duct 86, exclusively to the cycle IV.

In FIG. 6 use is made of the same references for parts corresponding to those of FIG. 5. The control device 100 is now diagrammatically indicated. The slides 81 and 82 occupy the positions shown in FIG. 5*a* (supply of working medium to cycle I). The cycles I, II, III and IV are completed in the working spaces 101, 102, 103 and 104, respectively. The said working spaces also have connected thereto communication ducts 105, 106, 107 and 108, respectively, each of which includes a non-return valve 109, 110, 111 and 112, respectively, which opens in the direction of the associated working space. The other ends of the communication ducts 105 to 108 are connected to a central communication duct 114, the other end of which is connected to the storage vessel 92 for pressurized working medium.

The central communication duct 114 includes a pressure-controlled switch 115 which comprise a switching member 116 which is subject on the one side to a compression spring 117 and the atmospheric pressure via an opening 118 in the housing 119, and on the other side to the pressure prevailing in the central communication duct 114. In the position of the switching member 116 shown, the variable cycle pressure $P_{II}$ derived from the working space 102 continues to act on the slides 81 and 82, while the central communication duct 114 is then interrupted.

Each of the non-return valves 109 to 112 opens if the cycle pressure occurring in the associated working space is lower than the pressure in the duct 114. Therefore, a pressure corresponding to the minimum cycle pressure normally prevails in the duct 114.

When working medium is supplied to the various cycles from the storage vessel 92, via the control device 100, each time during a given part of a cycle, in the present case each time at and near the instant of the maximum cycle pressure, the pressure level in the working spaces 101 to 104 increases, and hence the pressure in the duct 114 which corresponds to the minimum cycle pressure. Moreover, the pressure in the storage vessel 92 decreases. The switching member 115 then gradually assumes a new position, in which the variable cycle pressure $P_{II}$ to slides 81 and 82 is interrupted and a constant pressure starts to prevail at the relevant slide ends, so that the slides start to assume a given fixed position. The control device 100 is thus deactivated. The switching member 115 then also ensures that the central communication duct 114 is no longer interrupted. Working medium thus flows from the storage vessel 92 through the duct 114 to the non-return valves 109 to 112. Each of these valves is open during the part of the associated cycle in which the cycle pressure is lower than that in the duct 114. Thus, via the duct 114 working medium is applied to each working space during the period of minimum cycle pressure in this working space, beginning at the instant at which the pressure difference between the working medium pressure in the storage vessel 92 and the maximum cycle pressure in the working spaces has become so small that supplying at maximum cycle pressure is impeded.

Obviously, a variety of alternatives are feasible. For example, the communication ducts 105 to 108 and the non-return valves 109 to 112 can be formed by the supply ducts 83 to 86 and the non-return valves 87 to 90, respectively. The switch 115 could then switch off the control pressure $P_{II}$ and connect the storage vessel 92 directly to the supply ducts 83 to 86.

The switching member 116 can also be controlled in a different manner, for example, by applying pressures which correspond to the maximum and the minimum cycle pressure, respectively, on either side of the switching member 116.

What is claimed is:

1. A hot-gas reciprocating machine comprising two or more working spaces, the volumes of which can be varied at a mutual phase difference by piston-like bodies which are coupled to a crank shaft; a working medium performing a thermodynamic cycle in each of the said working spaces during operation, each of the working spaces being connected, via an associated supply duct which includes a non-return valve which opens in the direction of the relevant working space, to a control device which, during each revolution of the crank shaft, successively connects each of the supply ducts separately to a source of pressurized working medium; said control device comprising at least one control member which is slidable in a housing in the direction of its longitudinal axis under the influence of medium pressures which act on the control member in a mutually opposed sense, said housing comprising at least one inlet port which is connected to the source and at least one outlet port which is connected to the supply duct, characterized in that the control device is constructed so that each control member is controlled exclusively as a slide by two mutually phase-shifted cycle pressures which are associated per control member with different working spaces or, relative to the control members mutually, with different pairs of working spaces.

2. A hot-gas reciprocating machine as claimed in claim 1, additionally comprising a pressure-controlled switch included in a central communication duct which is connected on one side to the source of pressurized working medium and on the other side to the working spaces via communication ducts which are separately connected to the working spaces, each of said communication ducts including a non-return valve which opens in the direction of the associated working space, said switch being adapted to switch off the control device and to relese the central communication duct when a given pressure level in the working spaces is exceeded, and to close the central communication duct and to switch on the control device when the pressure falls below the given level.

* * * * *